US011365566B2

(12) United States Patent
Pettengill et al.

(10) Patent No.: US 11,365,566 B2
(45) Date of Patent: Jun. 21, 2022

(54) MOTOR VEHICLE LOCK, IN PARTICULAR A MOTOR VEHICLE DOOR LOCK

(71) Applicant: Kiekert AG, Heiligenhaus (DE)

(72) Inventors: Robert Pettengill, Farmington, MI (US); Robert Brickner, Berkley, MI (US); Stelian Borlodan, White Lake, MI (US)

(73) Assignee: Kiekert AG, Heiligenhaus (DE)

( * ) Notice: Subject to any disclaimer, the term of this patent is extended or adjusted under 35 U.S.C. 154(b) by 669 days.

(21) Appl. No.: 16/218,680

(22) Filed: Dec. 13, 2018

(65) Prior Publication Data

US 2020/0190862 A1 Jun. 18, 2020

(51) Int. Cl.
*E05B 77/06* (2014.01)
*E05B 79/08* (2014.01)
(Continued)

(52) U.S. Cl.
CPC ..... *E05B 77/06* (2013.01); *E05B 79/08* (2013.01); *E05B 79/10* (2013.01); *E05B 85/04* (2013.01); *Y10S 292/22* (2013.01)

(58) Field of Classification Search
CPC ..... Y10S 292/22; E05B 77/06
See application file for complete search history.

(56) References Cited

U.S. PATENT DOCUMENTS 5,865,481 A * 2/1999 Buschmann ..... E05B 77/06 292/216
2015/0308161 A1* 10/2015 Rosales ..... E05B 77/06 292/195

(Continued)

FOREIGN PATENT DOCUMENTS

DE 19511651 A1 * 10/1995 ..... E05B 77/06
DE 19738492 A1 * 3/1998 ..... E05B 77/06

(Continued)

OTHER PUBLICATIONS

International Search Report dated Mar. 6, 2020, for corresponding International Patent Application No. PCT/IB2019/060271.

(Continued)

*Primary Examiner* — Carlos Lugo
(74) *Attorney, Agent, or Firm* — Renner, Otto, Boisselle & Sklar, LLP

(57) ABSTRACT

A motor vehicle door lock includes a locking mechanism having a rotary latch, a pawl, and an actuating lever mechanism having at least one coupling lever rotatable about an axis and a mass inertia element rotatable about an additional axis spaced apart from the axis of the coupling lever to guide the coupling lever, at least in the event of an accident. The coupling lever in its "engaged" position connects the actuating lever mechanism mechanically with the locking mechanism and in its "disengaged" position ensures that the actuating lever mechanism is locked and/or separated from the locking mechanism. The mass inertia element has a guide contour for the coupling lever that interacts with a contact contour of the coupling lever so that the guide contour and/or contact contour is configured so that a force exerted upon it runs essentially tangentially to the diameter of the associated axis.

11 Claims, 3 Drawing Sheets

Figure 1:
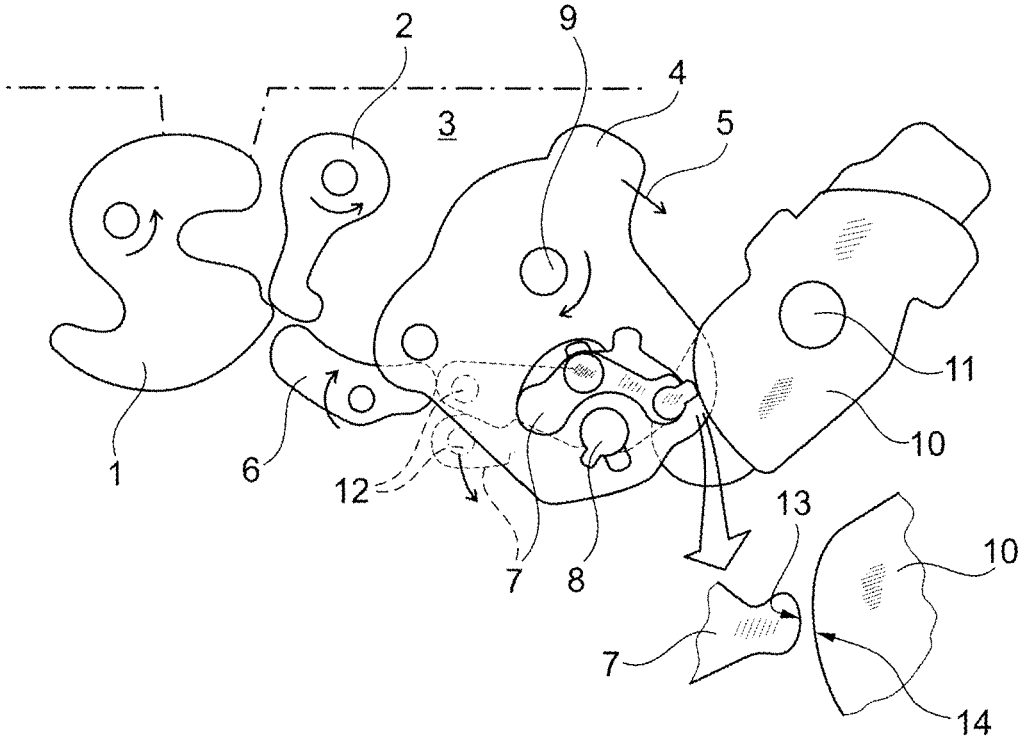

(51) Int. Cl.
*E05B 79/10* (2014.01)
*E05B 85/04* (2014.01)

(56) References Cited

U.S. PATENT DOCUMENTS

| | | | | |
|---|---|---|---|---|
| 2016/0258194 | A1* | 9/2016 | Rosales | E05B 77/06 |
| 2018/0038137 | A1 | 2/2018 | Damboiu et al. | |
| 2018/0044947 | A1 | 2/2018 | Manolescu et al. | |
| 2020/0190863 | A1* | 6/2020 | Borlodan | E05B 77/06 |

FOREIGN PATENT DOCUMENTS

| | | | | |
|---|---|---|---|---|
| DE | 202008012949 | U1 * | 3/2010 | E05B 79/20 |
| DE | 102015109946 | A1 * | 12/2016 | E05B 77/06 |
| DE | 102016112182 | | 1/2018 | |
| WO | 2015090286 | | 12/2014 | |

OTHER PUBLICATIONS

International Preliminary Report on Patentability dated Jun. 15, 2021 for corresponding International Patent Application No. PCT/IB2019/060271.

* cited by examiner

MOTOR VEHICLE LOCK, IN PARTICULAR A MOTOR VEHICLE DOOR LOCK

The invention relates to a motor vehicle lock, in particular a motor vehicle door lock having a locking mechanism essentially made up of a rotary latch and a pawl, further having an actuating lever mechanism for the locking mechanism with at least one coupling lever rotatable about an axis and having a mass inertia element rotatable about an additional axis that is spaced apart from the axis of the coupling lever in order to guide the coupling lever, at least in the event of an accident, the coupling lever in its "engaged" position mechanically connecting the actuating lever mechanism to the locking mechanism and in its "disengaged" position locking and/or mechanically separating the actuating lever mechanism from the locking mechanism.

The vehicle locks described above are generally vehicle door locks, meaning, for example, vehicle side door locks, vehicle hatchback locks or vehicle hood locks. In principle, however, seat locks and the like also fall under the term motor vehicle lock.

With vehicle locks and specifically vehicle door locks, there is the basic danger that in the event of a crash—meaning in the event of an accident and the increased deceleration forces associated with it that affect the vehicle lock—the actuating lever mechanism is inadvertently deflected and the associated locking mechanism is opened along with a vehicle door equipped with it. As a result of this, safety measures such as a side airbag or a side impact protection provided in or on the vehicle door could no longer produce any effect for the vehicle occupants. For this reason, one uses so-called mass inertia elements of the prior art that remain at rest in the event of a crash or are only minimally deflected. Using the relevant mass inertia element, the actuating lever mechanism can be mechanically interrupted and/or locked. In both cases, an outer door handle deflected, for example, in the event of a crash does not ensure that the locking mechanism is inadvertently opened.

In the prior art according to WO 2015/090286 A1, a locking device for a motor vehicle is described that is equipped with a coupling element and a release actuating lever for the lock mechanism. If the release actuating lever is actuated starting at an initial position, the coupling element connects the release actuating lever using the release lever to open the lock mechanism. If, however, the release actuating lever is excessively accelerated, the coupling element does not ensure that the release actuating lever is connected to the release lever to open the door. This means that in the "disengaged" position of the coupling element or coupling lever, the actuating lever mechanism is interrupted in the event of a crash.

In the generic prior art according to DE 10 2016 112 182 A1, a release lever and a coupling lever are realized as components of the actuating lever mechanism. The release lever can be connected to an actuating lever via the coupling lever. In addition, the coupling lever is guided by a control lever. The control lever, for its part, is moved by a control contour of a mass inertia element.

Prior art has fundamentally proven itself. However, in practice, problems of the sort can arise that the coupling lever in the event of a crash does not properly interact with the mass inertia element in order to leave the "engaged" position and transition into the "disengaged" position. This is essentially attributable to two phenomena. First, in practice, the coupling lever and the mass inertia element are often equipped with a journal and a stop or an arcuate contour that interact with each other in the event of a crash.

As a result of this, there is often only one minimal mechanical contact or a contact surface between the coupling lever on the one hand and the mass inertia element on the other is of small dimensions. Because of manufacturing tolerances, functional impairments can occur at this point via a mutual "hooking."

Moreover, it should also be noted that such a crash event must be flawlessly managed basically during the entire life of the auto. If one considers that automobiles today often have a lifetime of 10 and up to 15 years, then contamination in the contact region and/or corrosion between the coupling lever and the mass inertia element are conceivable and can also lead to functional impairments. The invention will remedy this situation in its entirety.

The invention is based on the technical problem of further developing a motor vehicle lock of this type, and in particular a motor vehicle door lock, in such a way that a flawless interaction is observed between the coupling lever and the mass inertia element, in particular in the event of a crash, and the coupling lever is transferred securely into its disengaged position.

To solve this technical problem, a generic motor vehicle lock and in particular a motor vehicle door lock in the context of the invention is characterized in that the mass inertia element has a guide contour for the coupling lever that interacts with a contact contour of the coupling lever in such a manner that the guide contour and/or the contact contour is configured so that a force exerted upon it runs essentially tangentially to the diameter of the associated axis.

According to the invention, the guide contour on the mass inertia element and/or the contact contour on the coupling lever thus undergoes a specific design and optimization. It must then be ensured here that the guide contour and/or contact contour in question is designed so that a force exerted upon it runs essentially tangentially to the diameter of the associated axis. For example, the coupling lever acts on the guide contour on the mass inertia element. So that the coupling lever is properly transferred from its "engaged" position into the "disengaged" position in the event of a crash in particular, the guide contour on the mass inertia element provides a form and design of this sort so that the force exerted by the coupling lever on the guide contour in question runs essentially tangentially in comparison to the diameter of the associated axis of the mass inertia element.

Because the mass inertia element in the event of a crash remains at rest or essentially at rest, the force exerted by the coupling lever deflected on the mass inertia element in the event of a crash is converted into a torque acting upon the coupling lever. This torque as a whole causes the coupling lever to be transferred from its previous position, meaning the "engaged" position assumed in normal operation, into the "disengaged" position in the event of a crash.

The force relationships remain essentially equal in this process because the guide contour on the mass inertia element is designed so that the force exerted upon it by the coupling lever in each case runs tangentially to the diameter of the axis of the mass inertia element. As the mass inertia element remains at rest in the event of a crash, this leads overall to the desired pivoting movement of the coupling lever because the mass inertia element exerts a corresponding counterforce on the coupling lever. Via the essentially tangential orientation of the forces exerted upon the guide contour on the part of the coupling lever, there is at this point a smooth desired movement of the coupling lever, even if a contact contour between the guide contour on the mass inertia element and the contact contour of the coupling lever is contaminated, as applicable, or has corrosion, etc. This means that the functionality is improved, and additionally and in particular over the long term.

Normally, it is thus the approach that the guide contour as well as the contact contour is designed so that each force exerted upon the other runs essentially tangentially to the respective diameter of the associated axis. This means that, at this point, the design as a whole is made so that the guide contour on the mass inertia element as well as the contact contour of the coupling lever ensure that the respective forces exerted upon them run tangentially to the diameter of the associated axis This specifically means that not only the coupling lever exerts forces upon the guide contour on the mass inertia element as described in the event of a crash. Instead, the guide contour on the mass inertia element, on its part, also transfers to the coupling lever counterforces that at this point act on the contact contour of the coupling lever designed according to the invention. These counterforces again and according to the invention run tangentially to the diameter of the associated axis, in the present case the axis of the coupling lever. As a result of this, according to the invention, there is a rolling motion between the guide contour on the mass inertia element, on the one hand, and the contact contour on the coupling lever, on the other, with formation of a significantly large contact surface. This rolling motion is characterized in that here the respective forces acting upon the guide contour or contact contour run tangentially to the associated diameter of the axis or axis of rotation. In this manner, corresponding proper torques are transferred without additionally produced forces so that a hooking, non-circular motion and, as a result of this, any functional disruptions are prevented by design. Even possible impairments of the guide contour with respect to the contact contour by contamination, possible corrosion, etc. do not adversely affect this basic design over the long term. The essential advantages can be seen here.

According to an advantageous embodiment, the diameter of the axis of the mass inertia element and/or the diameter of the axis of the coupling lever can be selected as a function of the respective desired resistance to rotational movements. This means that the larger the diameter of the axis that is chosen, the smaller also is the respective resistance with respect to rotational movements. In other words, a large diameter of the axis corresponds to the fact that small resistance must first be overcome in order to be even able to initiate a rotational movement created by the applied force, and vice versa. In this context, specifying the diameter longitudinally as part of a radius of inertia has proven effective.

In a known way, the radius of inertia indicates the distance from the associated axis or axis of rotation in that the punctiform mass of the element in question (the mass inertia element or of the coupling lever) must be applied in order to obtain the associated moment of inertia of the element in question. Naturally, the mass inertia element has a moment of inertia many times greater than the coupling lever, so that in the event of a crash, the mass inertia element essentially remains at rest and can also remain at rest while, in contrast, the coupling lever is pivoted and therefore is transferred from its previously assumed "engaged" position into the "disengaged" position.

In the context of the exemplary embodiment, the diameter of the mass inertia element and/or of the coupling lever can be designed, for example, so that it is between 10% and 80% of the length of the radius of inertia and in particular between 20% and 60% of the length of the radius of inertia. This clearly applies only as an example and is in no way to be understood as limiting.

According to an advantageous embodiment, the guide contour and/or the contact contour are designed as involutes. Such an involute arises in a known way by "unwinding," so to speak, of respective tangents to the diameter of the associated axis. As a result of this, the associated guide contour of the mass inertia element that is configured as an involute appears in an unwinding of the tangents from the diameter of the mass inertia element. The coupling lever can be made and operated in the same way. In this case, the contact contour of the coupling lever designed as an involute is produced by the individual tangents at the diameter of the axis of the coupling lever being unwound.

Specifically, and especially advantageously, the relevant involute is designed as an involute of a circle. In this case, one begins with a circle as the involute, i.e. that the unwinding of the tangents in question occurs in each case starting from a circle. The invention here takes into account that the relevant diameter of the associated axis of the mass inertia element, on the one hand, and of the coupling lever, on the other, correspond to a circular surface, which is generally the case. In the case of an involute of a circle, the length of each individual tangent to the diameter of the associated axis for the unwinding of the involute increases by the amount of the arc length between adjacent tangents. In other words, the involute of a circle describes a spiral having a constant pitch. It is produced conceptually as a track of a thread-like element that is unwound with tension from the circumference of the associated axis, meaning the axis of the mass inertia element and/or the axis of the coupling lever. In each case, this specific design as a whole causes the contact contour on the coupling lever to similarly roll over the guide contour of the mass inertia element at least in the event of a crash, as is known from involute teeth in gears.

Such involute gear teeth are basically also known and in connection with vehicle door locks, as US 2018/0038137 A1 documents with the explanatory notes in section [0084] there. In any case, a crash event and with it the interaction between the mass inertia element and the coupling lever according to the invention is not described in this context. In any case, involutes and specifically involutes of a circle are known in principle, but not for the design of a guide contour in a mass inertia element and/or the associated contact contour of the coupling lever. This leads altogether to the previously described, functionally reliable and smooth operation and to the coupling lever being thereby transferred from the normal "engaged" position assumed in normal operation into the "disengaged" position, at least in the event of a crash. As a result of this, the actuating lever mechanism is mechanically separated from the locking mechanism so that even the displacement of the associated outer door handle or interior door handle as a result of the acting deceleration forces cannot result in an inadvertent opening of the locking mechanism.

In the same way, such an inadvertent opening of the locking mechanism is prevented if the coupling lever locks the actuating lever mechanism in its "disengaged" position. Also in this case, a possible deflection of the door outer handle or door inner handle caused by the deceleration forces being exerted cannot be transferred to the locking mechanism. In all cases considered, this remains locked so that the associated vehicle door cannot be opened in any case.

In general, the actuating lever mechanism has, in addition to the previously mentioned coupling lever, at least one actuating lever and, as needed, a release lever. The actuating lever generally acts on the release lever that, in turn, in the closed position of the locking mechanism lifts a pawl that is engaged with the rotary latch from the rotary latch. The actuating lever mechanism is then mechanically connected to the locking mechanism, and the coupling lever in normal operation is in its "engaged" position. In the event of a crash and in the "disengaged" position of the coupling lever, the actuating lever mechanism is mechanically interrupted or locked so that the release lever cannot lift the pawl from the rotary latch.

In detail, it has proven effective if the coupling lever is rotatably mounted on the actuating lever. The actuating lever can thus in turn be mounted in a lock case or lock housing. The same applies to a locking mechanism comprising a rotary latch and a pawl. The essential advantages can be seen here.

Figure 2:
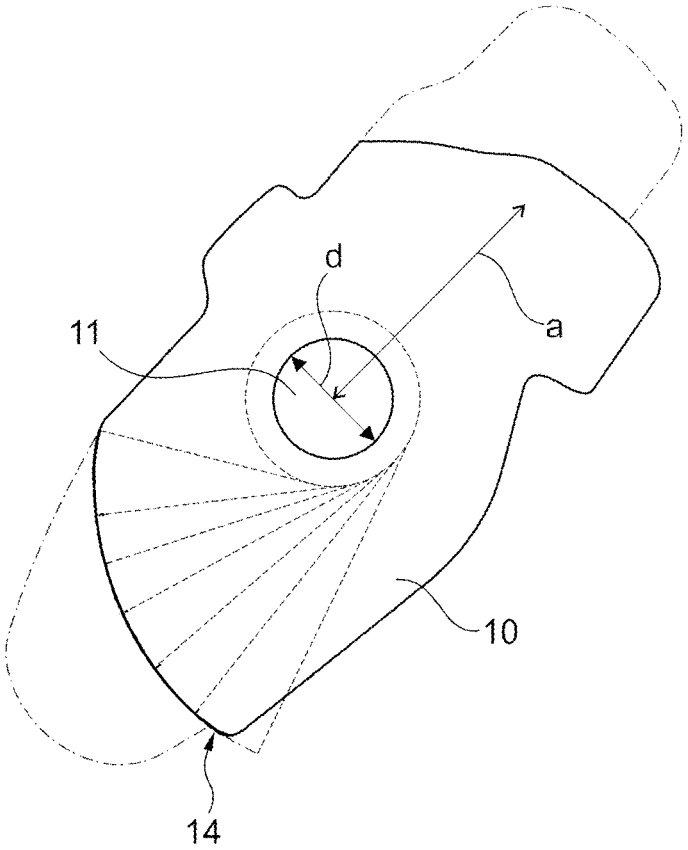

The invention is explained in detail below in reference to a drawing representing only one exemplary embodiment; shown are:

FIG. 1 the vehicle lock according to the invention in a top view,

FIG. 2 the mass inertia element in a detail view and

Figure 3:
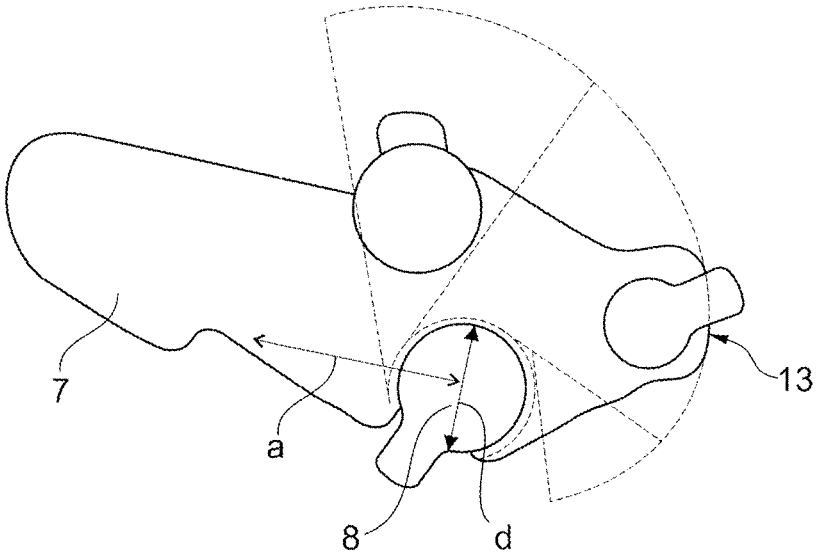

FIG. 3 the coupling lever in an individual view.

A motor vehicle lock is shown in the figures. The motor vehicle lock is not limited to a vehicle door lock that is equipped with a locking mechanism 1, 2 essentially comprising a rotary latch 1 and a pawl 2. Rotary latch 1 and pawl 2 are mounted in an indicated lock case 3 or a lock housing. In addition, an actuating lever mechanism 4, 5, 6, 7 is realized for locking mechanism 1, 2. Actuating lever mechanism 4, 5, 6, 7 provides at least one coupling lever 7 that can be rotated about axis 8 for locking mechanism 1, 2.

In detail, actuating mechanism 4, 5, 6, 7 first comprises an actuating lever or outer actuating lever 4, a door outer handle 5 indicated by only one arrow, a release lever 6 and finally coupling lever 7. Release lever 6 is rotatably mounted in lock case 3. The same applies for the actuating lever or outer actuating lever 4, which, while defining an axis 9, is also mounted in lock case 3. By contrast, coupling lever 7 is mounted on actuating lever or outer actuating lever 4, namely rotatably about its axis 8.

A mass inertia element 10 also belongs to the basic design. The mass inertia element is mounted about an additional axis 11 that, compared to axis 8 of coupling lever 7, is arranged at a distance in the interior of the motor vehicle door lock. Mass inertia element 10 with its axis 11 is further illustrated in detail in FIG. 2. FIG. 3 shows coupling lever 7 with its axis 8 in an individual view.

In FIG. 1, locking mechanism 1, 2 is shown in the closed state. In addition, the normal operation is shown as a solid line, in contrast to which the dashed position of coupling lever 7 corresponds to the crash case. In normal operation, an impact of the door handle in the direction of the arrow 5 ensures that actuating lever or outer actuating lever 4 is pivoted about its axis 9 in the clockwise manner indicated here. Coupling lever 7 rotatably mounted on actuating lever 4 now provides a journal 12 that runs against release lever 6 during the described pivoting movement of actuating lever 4 in normal operation and in the clockwise direction during an opening procedure of locking mechanism 1, 2.

As a result of this opening movement, release lever 6 mounted in lock case 3 also pivots in the clockwise direction indicated in FIG. 1 and ensures that the pawl 2 engaged into rotary latch 1 in the locked state shown in fig, 1 is lifted from its engagement with rotary latch 1. This is because the clockwise rotation of release lever 6 causes pawl 2 to be pivoted in the clockwise direction and lifted from its engagement with rotary latch 1. As a result of this, rotary latch 1 can swing up in the counter-clockwise direction supported by a spring and release a previously hooked and merely hinted at locking bolt. The associated motor vehicle door can be opened.

In the event of a crash, however, the crash event corresponds in such a way that deceleration forces acting on coupling lever 7 ensure that coupling lever 7 executes a pivoting motion in the counter-clockwise direction about its axis 8 relative to actuating lever 4 as indicated by a dashed line in FIG. 1. The pivoting motion of coupling lever 7 is thus undertaken regardless of a possible additional pivoting motion of actuating lever 4 caused by exerted decelerating forces. This is because coupling lever 7 is equipped, for this purpose and in detail, with a contact contour 13 that interacts with an associated guide contour 14 on mass inertia element 10. The interaction between the two contours 13, 14 thus takes place at least in the event of a crash and regardless of whether or not actuating lever 4 also executes a clockwise movement about its axis 9 that is initiated by the exerted deceleration forces and a deflection of door outer handle 5.

Contact contour 13 of coupling lever 7 as well as guide contour 14 on mass inertia element 10 as well as their respective designs are illustrated in detail in FIGS. 2 and 3. This creates, overall and at least in the event of a crash, a contact contour of significant size between contact contour 13 of coupling lever 7 and guide contour 14 of mass inertia element 10, thereby ensuring a flawless mode of operation and in detail guaranteeing that, at least in the crash event described here, coupling lever 7 is transferred by the interaction between coupling lever 7 and mass inertia element 10 from its "engaged" position, represented as a solid line, into the "disengaged" position, rendered as a dashed line and corresponding to a counter-clockwise movement of coupling lever 7 about its axis 8.

In the "engaged" position of coupling lever 7, as illustrated as a solid line in FIG. 1, an actuation of actuating lever 4 in the indicated clockwise direction about axis 9 renders journal 12 of coupling lever 7 able to act on release lever 6 as described, so that locking mechanism 1, 2 is opened as a final effect. If, however, coupling lever 7 in the event of a crash is, transferred by its interaction with mass inertia element 10 into its "disengaged" position indicated as a dashed line in FIG. 1, then journal 12 is separated from release lever 6. A possible impact of actuating lever 4 in the clockwise direction, and thus in the opened state, is consequently not (no longer) transferred to locking mechanism 1, 2. Locking mechanism 1, 2 consequently remains in the closed state illustrated in FIG. 1. An associated motor vehicle door is not inadvertently opened.

According to the invention, guide contour 14 of mass inertia element 10 and also contact contour 13 of coupling lever 7 are designed in such a way that relevant forces exerted upon mass inertia element 10 or coupling lever 7 run essentially tangentially to relevant diameter d of associated axis 8 or 11. According to the exemplary embodiment and the illustration following in FIGS. 2 and 3, guide contour 14 as well as contact contour 13 are designed so that relevant forces of mass inertia element 10 or coupling lever 7 exerted upon each other run essentially tangentially to the relevant diameter of associated axis 8 or 11. According to the exemplary embodiment, contact contour 13 as well as guide contour 14 are each involutes of a circle.

For example, looking at mass inertia element 10 in FIG. 2, it can be recognized that diameter d of axis of rotation 11 of mass inertia element 10 as a whole describes a circle as an involute. If coupling lever 7 now exerts a force upon guide contour 14 on mass inertia element 10 in the event of a crash, the relevant force in each case runs essentially tangentially as compared to diameter d of associated axis 11 in question, as the individual tangents indicated in FIG. 2 make clear. Guide contour 14 of mass inertia element 10 or the involute of a circle realized at this position is now formed and designed so that each individual tangent is unwound at diameter d of axis 11 from diameter d. Because this is also an involute of a circle, the length of the respective tangents thus similarly increases by the amount of the arcuate length between adjacent tangent as if a thread wound onto axis 11 of diameter d were unwound. The tangents increasing in this manner with respect to their lengths describe the involute of a circle or guide surface 14 of mass inertia element 10.

A similar process takes place for contact contour 13 of coupling lever 7 in FIG. 3. Also in this case, it is an involute of a circle, diameter d of axis 8 representing the involute. Any forces exerted by mass inertia element 10 upon coupling lever 7 again run essentially tangentially to diameter d in question of associated axis 8 of coupling lever 7, as is indicated in FIG. 3. Contact contour 13 is again designed as an involute of a circle here, so that the length of each individual tangent at diameter d of axis 8 for unwinding the involute of a circle increases by the amount of the arcuate lengths between adjacent tangents, comparable to how this was previously described for guide contour 14.

As a result of this, in the event of a crash, it happens that contact contour 13 of coupling lever 7 designed as an involute or involute of a circle rolls over on associated guide contour 14 of mass inertia element 10 also designed as an involute or involute of a circle. The rolling movement here takes place in a manner comparable to a rolling movement in an involute gearing of a transmission. This ensures an especially smooth rotational motion of coupling lever 7 from its "engaged" position, shown in FIG. 1 as a solid line, into the "disengaged" position rendered as a dashed line.

Mass inertia element 10 actually remains essentially at rest in the event of a crash so that contact contour 13 on coupling lever 7 rolls over, and also can roll over, guide contour 14 of mass inertia element 10 as described. This rolling movement between the two contours 13, 14 is one between two involutes of a circle so that the respective force exerted by coupling lever 7 on mass inertia element 10, on the one hand, and the counterforce of mass inertia element 10 on coupling lever 7, on the other, extends tangentially in each case to associated diameter d of corresponding axis 8 or 11. This leads to a particularly uniform and smooth operation and to a functionally reliable assumption of the "disengaged" position of coupling lever 7, in particular in the event of a crash.

Finally, it can be recognized in FIGS. 2 and 3 that diameter d of axis 11 of mass inertia element 10 as well as diameter d of axis 8 of coupling lever 7, as appropriate, can be selected as a function of the relevant desired resistance to rotational movements. The larger the diameter d of associated axis 8 or 11, the smaller the resistance in question with respect to rotational movements and vice versa. In addition, in FIGS. 2 and 3, yet another relevant radius of inertia a is reproduced and pictorially represented of mass inertia element 10, on the one hand, and of coupling lever 7, on the other. Associated diameter d is now measured longitudinally as part of associated radius of inertia a. In the case of mass inertia element 10 in FIG. 2, the configuration is designed in such a way that diameter d of associated axis 11 is approximately 40% of the length of radius of inertia a. In the case of coupling lever 7 in FIG. 3, diameter d of associated axis 8, however, is measured at approximately 60% of radius of inertia a. This clearly is only applied as an example and is in no way limiting.

LIST OF REFERENCE NUMBERS

1 Rotary latch
1, 2 Locking mechanism
2 Pawl
3 Lock case
4 Actuating lever/outer actuating lever
4, 5, 6, 7 Actuating lever mechanism
5 Exterior door handle/direction of the arrow
6 Release lever
7 Coupling lever
8 Axis
9 Axis
10 Mass inertia element
11 Axis/Axis of rotation
12 Journal
13 Contact contour
13, 14 Contours
14 Guide contour
a Radius of inertia
d Diameter

The invention claimed is:

1. A motor vehicle lock comprising:

a locking mechanism having a rotary latch and a pawl; and an actuating lever mechanism for the locking mechanism, the actuating lever mechanism having a coupling lever that is rotatable about an axis and a mass inertia element rotatable about an additional axis that is spaced apart from the axis of the coupling lever in order to guide the coupling lever during a crash, wherein the coupling lever has an engaged position in which the coupling lever mechanically connects the actuating lever mechanism to the locking mechanism and a disengaged position in which the coupling lever mechanically separates the actuating lever mechanism from the locking mechanism, wherein the mass inertia element has a guide contour for the coupling lever that directly contacts a contact contour of the coupling lever, wherein during the crash, increased deceleration forces that act on the coupling lever cause a force to be exerted by the coupling lever whereby the coupling lever contacts the mass inertia element so that the contact contour will roll over the guide contour, wherein the force runs tangentially to a diameter of the additional axis of the mass inertia element, wherein the mass inertia element exerts a corresponding counterforce on the coupling lever, the counterforce running tangentially to a diameter of the axis of the coupling lever and causing the coupling lever to move to the disengaged position, wherein each of the guide contour and the contact contour has an involute shape of a circle;

wherein the actuating lever mechanism has an actuating lever and a release lever; and wherein the coupling lever is rotatably mounted on the actuating lever.

2. The motor vehicle lock according to claim 1, wherein each of the diameter of the additional axis and the diameter of the axis is longitudinally configured as a part of a radius of inertia of the mass inertia element or of the coupling lever.

3. The motor vehicle lock according to claim 2, wherein the diameter is 10% to 80% of a length of the radius of inertia of the mass inertia element.

4. The motor vehicle lock according to claim 3, wherein the diameter is 20% to 60% of the length of the radius of inertia of the mass inertia element.

5. The motor vehicle lock according to claim 1, wherein during the crash, the contact contour of the coupling lever is configured to roll over the guide contour of the mass inertia element.

6. The motor vehicle lock according to claim 1, wherein during the crash, the coupling lever is configured to rotate with respect to the mass inertia element.

7. The motor vehicle lock according to claim 1, wherein the involute shape is formed of unwinding tangents from a diameter of the mass inertia element.

8. The motor vehicle lock according to claim 7, wherein a length of each of the unwinding tangents increases by an amount of an arc length between adjacent tangents.

9. The motor vehicle lock according to claim 1, wherein the coupling lever includes a journal that is engageable against the release lever and separable from the release lever.

10. A motor vehicle lock comprising:

a locking mechanism having a rotary latch and a pawl; and an actuating lever mechanism for the locking mechanism, the actuating lever mechanism having a coupling lever that is rotatable about an axis and a mass inertia element rotatable about an additional axis that is spaced apart from the axis of the coupling lever in order to guide the coupling lever during a crash, wherein the coupling lever has an engaged position in which the coupling lever mechanically connects the actuating lever mechanism to the locking mechanism and a disengaged position in which the coupling lever mechanically separates the actuating lever mechanism from the locking mechanism, wherein the mass inertia element has a guide contour for the coupling lever that interacts with a contact contour of the coupling lever, wherein during the crash, increased deceleration forces that act on the coupling lever cause a force to be exerted by the coupling lever whereby the coupling lever contacts the mass inertia element so that the contact contour will roll over the guide contour, wherein the force runs tangentially to a diameter of the additional axis of the mass inertia element, wherein the mass inertia element exerts a corresponding counterforce on the coupling lever, the counterforce running tangentially to a diameter of the axis of the coupling lever and causing the coupling lever to move to the disengaged position, wherein the actuating lever mechanism has an actuating lever and a release lever, and wherein the coupling lever is rotatably mounted on the actuating lever.

11. The motor vehicle lock according to claim 10, wherein the coupling lever includes a journal that is engageable against the release lever and separable from the release lever.

* * * * *